US007576717B2

(12) United States Patent
Lee et al.

(10) Patent No.: US 7,576,717 B2
(45) Date of Patent: Aug. 18, 2009

(54) LIGHT EMITTING DISPLAY AND DRIVING METHOD THEREOF

(75) Inventors: Jae Sung Lee, Seoul (KR); Yang Wan Kim, Seoul (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 719 days.

(21) Appl. No.: 11/213,320

(22) Filed: Aug. 26, 2005

(65) Prior Publication Data

US 2006/0071888 A1 Apr. 6, 2006

(30) Foreign Application Priority Data

Aug. 30, 2004 (KR) ..... 10-2004-0068404

(51) Int. Cl.
*G09G 3/30* (2006.01)

(52) U.S. Cl. ..... 345/77; 345/82; 345/690

(58) Field of Classification Search ..... 345/76, 345/77, 82, 204, 205, 690; 340/FOR. 281; 250/553

See application file for complete search history.

(56) References Cited

U.S. PATENT DOCUMENTS

| | | | | |
|---|---|---|---|---|
| 5,343,215 | A | 8/1994 | Tanaka | |
| 6,583,775 | B1 * | 6/2003 | Sekiya et al. | 345/76 |
| 7,102,161 | B2 * | 9/2006 | Inukai | 257/59 |
| 7,123,220 | B2 * | 10/2006 | Hanari et al. | 345/77 |
| 7,164,401 | B2 * | 1/2007 | Kwon | 345/82 |
| 7,205,965 | B2 * | 4/2007 | Mikami et al. | 345/76 |
| 7,227,517 | B2 * | 6/2007 | Imamura | 345/76 |
| 7,256,774 | B1 * | 8/2007 | Senda et al. | 345/204 |
| 7,259,735 | B2 * | 8/2007 | Kasai | 345/77 |
| 7,317,433 | B2 * | 1/2008 | Chen et al. | 345/76 |
| 7,355,459 | B2 * | 4/2008 | Miyazawa | 327/112 |
| 7,365,719 | B2 * | 4/2008 | Miyagawa | 345/82 |

(Continued)

FOREIGN PATENT DOCUMENTS

JP 2000-221944 8/2000

(Continued)

OTHER PUBLICATIONS

Patent Abstracts of Japan, Publication No. 2001-060076, dated Mar. 6, 2001, in the name of Mitsunobu Sekiya et al.

(Continued)

*Primary Examiner*—Richard Hjerpe
*Assistant Examiner*—Tom V Sheng
(74) *Attorney, Agent, or Firm*—Christie Parker & Hale LLP

(57) ABSTRACT

A light emitting display and a driving method thereof. The light emitting display includes an image displaying part including a plurality of pixels electrically connected to a plurality of scan lines, a plurality of data lines, and a plurality of emission control lines. A controller generates a start signal having a pulse width corresponding to a number of '1s' or '0s' of video data. A data driver converts the video data into a data signal to supply the data signal to the data lines. A scan driver supplies a scan signal to the scan lines, and an emission control signal supplier generates an emission control signal for controlling an emitting period of at least one of the pixels in response to a start signal supplied from the controller and supplies the emission control signal to the emission control lines.

20 Claims, 13 Drawing Sheets

U.S. PATENT DOCUMENTS

| | | | | |
|---|---|---|---|---|
| 2004/0113873 | A1* | 6/2004 | Shirasaki et al. | 345/76 |
| 2004/0263506 | A1* | 12/2004 | Koyama et al. | 345/204 |
| 2005/0024351 | A1* | 2/2005 | Sano | 345/204 |
| 2005/0046619 | A1* | 3/2005 | Senda et al. | 345/76 |
| 2005/0083268 | A1 | 4/2005 | Mori et al. | |

FOREIGN PATENT DOCUMENTS

| | | |
|---|---|---|
| JP | 2001-60076 | 3/2001 |
| WO | WO 03/058593 | 7/2003 |

OTHER PUBLICATIONS

Patent Abstract of Japan, Publication No. 2000-221944, dated Aug. 11, 2000, in the name of Koji Ogusu.

* cited by examiner

LIGHT EMITTING DISPLAY AND DRIVING METHOD THEREOF

CROSS-REFERENCE TO RELATED APPLICATIONS

This application claims priority to and the benefit of Korean Patent Application No. 10-2004-0068404, filed on Aug. 30, 2004, in the Korean Intellectual Property Office, the entire content of which is incorporated herein by reference.

BACKGROUND OF THE INVENTION

1. Field of the Invention

The present invention relates to a light emitting display and a driving method thereof, and more particularly, to a light emitting display and a driving method thereof, in which an emitting period of a light emitting device is partially shortened to limit brightness, so that light emitted from the light emitting device is prevented from exceeding in brightness, and a power supply is protected from being overloaded.

2. Discussion of Related Art

Recently, various flat panel displays have been developed to substitute for a cathode ray tube (CRT) display because the CRT display is relatively heavy and bulky. The flat panel display includes a liquid crystal display (LCD), a field emission display (FED), a plasma display panel (PDP), a light emitting display (LED), etc.

Among the flat panel displays, the light emitting display can emit light for itself by electron-hole recombination. The light emitting display can be classified according to materials into an inorganic light emitting display including an inorganic emitting layer and an organic light emitting display including an organic emitting layer. The light emitting display may also be referred to as an electroluminescent display.

Like a CRT display, such a light emitting display has a fast response time as compared with an LCD display that requires a separate light source.

As for the light emitting display, the organic light emitting display has an organic light emitting device including an organic emitting layer provided between an anode electrode and a cathode electrode, an electron transport layer, and a hole transport layer. Additionally, the organic light emitting device may include an electron injection layer and a hole injection layer.

In the organic light emitting device, when a voltage is applied between the anode electrode and the cathode electrode, electrons generated from the cathode electrode are moved to the emitting layer via the electron injection layer and the electron transport layer, and holes generated from the anode electrode are moved to the emitting layer via the hole injection layer and the hole transport layer. Then, the electrons from the electron transport layer and the holes from the hole transport layer are recombined in the emitting layer, thereby emitting light.

Such a conventional light emitting display displays an image by controlling the brightness of the light emitting device on the basis of the amount of current corresponding to a data signal. At this time, the conventional light emitting display receives the current from a power supply so as to control the light emitting device to emit light. Here, the power supply is designed on the basis of a current required when a white signal is displayed on a predetermined area of an image displaying part in a normal black mode. Thus, current consumption increases as the brightness of the image displaying part increases.

In the conventional light emitting display, when the high brightness of an image displayed on the image displaying part continues for a relatively long time, the power supply is overloaded, thereby damaging electric components and electronic components. Consequently, in a case where the brightness of the image displaying part requires current higher than the maximum current that the power supply is designed to provide, a problem arises in that the power supply is not only deteriorated in performance and driving efficiency but also operates abnormally or does not operate.

Further, in the conventional light emitting display, the light is excessively emitted in proportion to an area corresponding to the light emitting device which is turned on, so that the brightness of the light emitting devices is wastefully increased, thereby increasing power consumption and reducing the lifespan of the light emitting device.

SUMMARY OF THE INVENTION

Accordingly, it is an aspect of the present invention to provide a light emitting display and a method of driving the same, in which an emitting period of a light emitting device is partially shortened to limit brightness, so that light emitted from the light emitting device is prevented from exceeding in brightness, and a power supply is protected from being overloaded.

The foregoing and/or other aspects of the present invention are achieved by providing a light emitting display including: an image displaying part including a plurality of pixels electrically connected to a plurality of scan lines, a plurality of data lines, and a plurality of emission control lines; a controller adapted to generate a start signal having a pulse width corresponding to a number of '1s' or '0s' of video data; a data driver for converting the video data into a data signal to supply the data signal to the data lines; a scan driver adapted to supply a scan signal to the scan lines; and an emission control signal supplier for generating an emission control signal for controlling an emitting period of at least one of the pixels in response to the start signal supplied from the controller and for supplying the emission control signal to the emission control lines.

Still other aspects of the present invention are achieved by providing a method of driving a light emitting display, including: (a) generating a start signal having a pulse width corresponding to a number of '1s' or '0s' of video data; (b) generating an emission control signal corresponding to the pulse width of the start signal; (c) converting the video data into a data signal; and (d) supplying a current corresponding to the data signal to a light emitting device in response to a scan signal to make the light emitting device emit light, wherein an emitting period of the light emitting device in (d) is controlled by the emission control signal.

BRIEF DESCRIPTION OF THE DRAWINGS

These and/or other aspects and features of the present invention will become apparent and more readily appreciated from the following description of the exemplary embodiments, taken in conjunction with the accompanying drawings of which.

DETAILED DESCRIPTION

Hereinafter, certain exemplary embodiments according to the present invention will be described with reference to the accompanying drawings. The exemplary embodiments of the present invention are provided to be readily understood by those skilled in the art.

Figure 1:
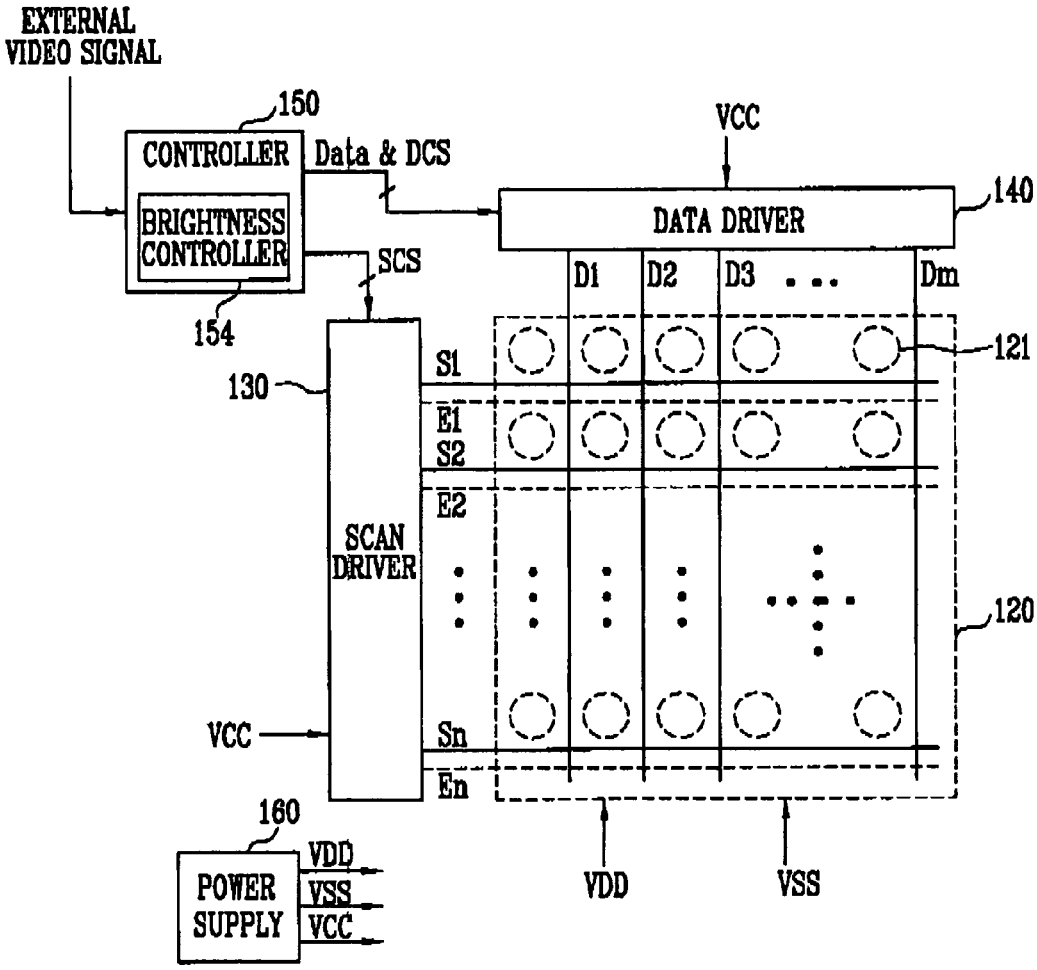
FIG. 1 illustrates a light emitting display according to a first exemplary embodiment of the present invention.

FIG. 1 illustrates a light emitting display according to a first exemplary embodiment of the present invention.

Referring to FIG. 1, a light emitting display according the first exemplary embodiment of the present invention includes an image displaying part 120, a scan driver 130, a data driver 140, a controller 150, and a power supply 160.

The image displaying part 120 includes a plurality of pixels 121 defined by a plurality of scan lines S1 through Sn, a plurality of data lines D1 through Dm, and a plurality of emission control lines E1 through En, where n and m are natural numbers. Each pixel 121 is selected by a scan signal supplied from the scan driver 130 to the scan lines S1 through Sn, and the selected pixel 121 emits light based on the amount of current corresponding to a data signal supplied from the data driver 140 to the data lines D1 through Dm, thereby displaying an image.

The power supply 160 generates driving voltages needed for driving the light emitting display. That is, the power supply 160 generates a driving voltage VCC needed for driving the scan driver 130 and the data driver 140. Further, the power supply 160 generates a first voltage VDD and a second voltage VSS needed for the image displaying part 120.

The controller 150 arranges an external video signal (e.g., RGB) into the data signal for driving the image displaying part 120, and supplies the data signal to the data driver 140. Further, the controller 150 controls the scan driver 130 and the data driver 140.

The scan driver 130 generates scan signals in response to scan control signals (SCS) supplied from the controller 150, i.e., in response to a start pulse signal and a clock signal so as to drive the scan lines S1 through Sn in sequence, and supplies the scan signals to the scan lines S1 through Sn. Further, the scan driver 130 generates emission control signals to drive the emission control lines E1 through En, and supplies the emission control signals to the emission control lines E1 through En in sequence.

The data driver 140 converts digital video data Data received from the controller 150 into the data signal in response to a data control signal (DCS) supplied from the controller 150, and supplies the data signal to the data line (i.e., the data lines D1 through Dm). Here, the data driver 140 can be embedded in a substrate included in the image displaying part 120, or provided outside the substrate.

Figure 2:
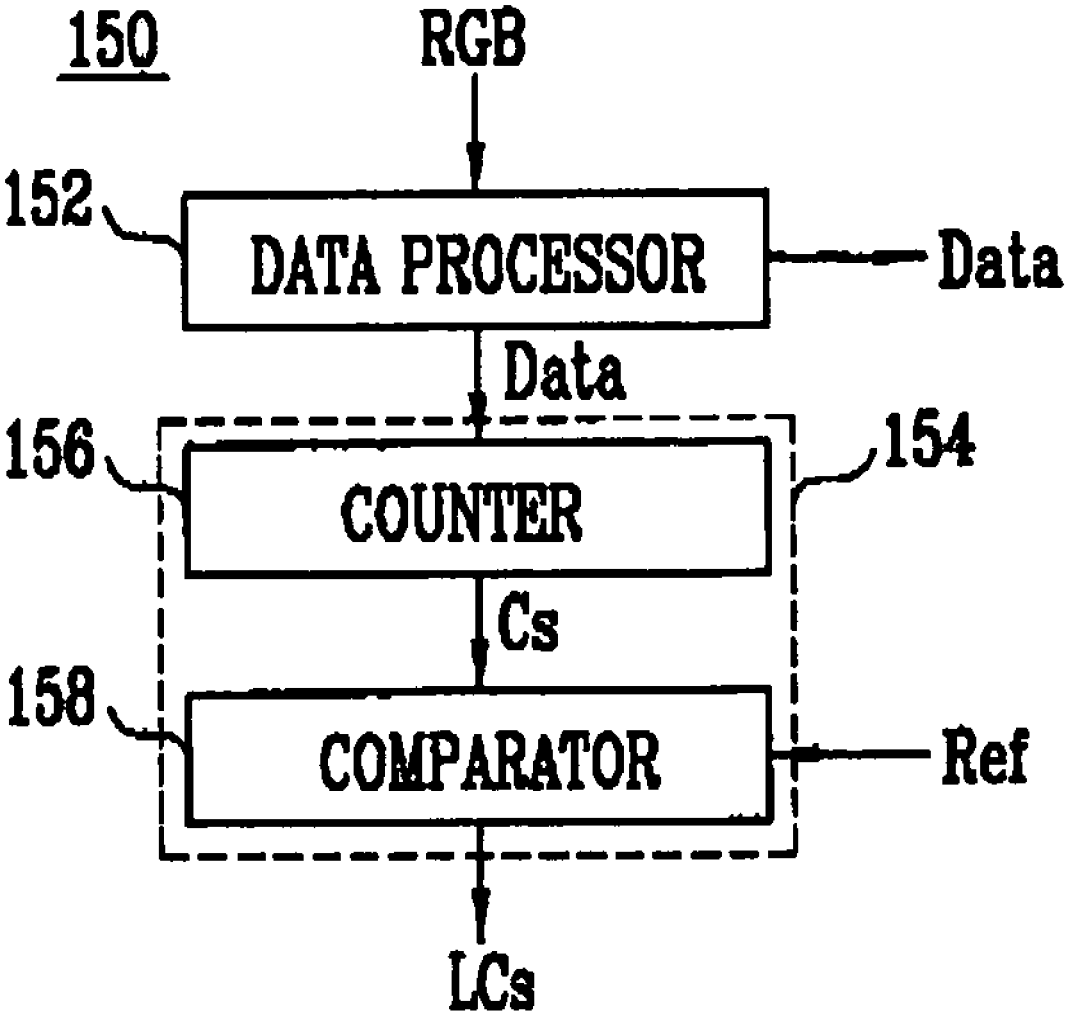
FIG. 2 illustrates a controller of FIG. 1.

FIG. 2 illustrates the controller 150 of FIG. 1.

Referring to FIG. 2 in association with FIG. 1, the controller 150 includes a data processor 152 and a brightness controller 154.

The data processor 152 arranges the video signal RGB supplied externally as frames into the digital video data Data for driving the image displaying part 120, and supplies the arranged digital video data Data to the data driver 140.

The brightness controller 154 includes a counter 156 and a comparator 158. The counter 156 counts the number of white signals, i.e., the number of '1s' among the most significant bits MSB of the digital video data Data supplied from the data processor 152, and supplies a count signal Cs to the comparator 158. Alternatively, the counter 156 may count the number of '1s' among the most significant bits MSB and/or among the second most significant bits MSB−1 (i.e., bits that are at the bit position right next to the MSB) of the digital video data Data supplied from the data processor 152, and supply the count signal Cs to the comparator 158. Further, the counter 156 may count the number of '1s' among (N/2)+1 through N bits of N-bit digital video data Data supplied from the data processor 152, where N is a positive integer, and supply the count signal Cs to the comparator 158. In other embodiments, the counter may count the number of '0s' instead of or in addition to the number of '1s'.

The comparator 158 compares the count signal Cs received from the counter 156 with a preset reference value Ref, thereby generating a brightness control signal LCs. At this time, the preset reference value Ref corresponds to the number of white signals for one frame image supplied to a predetermined area of the image displaying part 120. The preset reference value Ref, for example, may correspond to the number of digital video data Data having a value of '1' for one frame supplied to a half area (50%) of the image displaying part 120. Here, the preset reference value Ref has a value corresponding to the number of '1s' of the data supplied to a half area (50%) of the image displaying part 120. For example, when the counter 156 counts the number of the most significant bits MSB, the preset reference value Ref has a value corresponding to the case where the most significant bits MSB of the data supplied to the half area of the image displaying part 120 are all set as '1'. Further, when the counter 156 counts the number of the most significant bits MSB and the second most significant bits MSB−1, the preset reference value Ref has a value corresponding to the case where the most significant bits MSB and the second most significant bits MSB−1 of the data supplied to the half area of the image displaying part 120 are all set as '1'.

Figure 3:
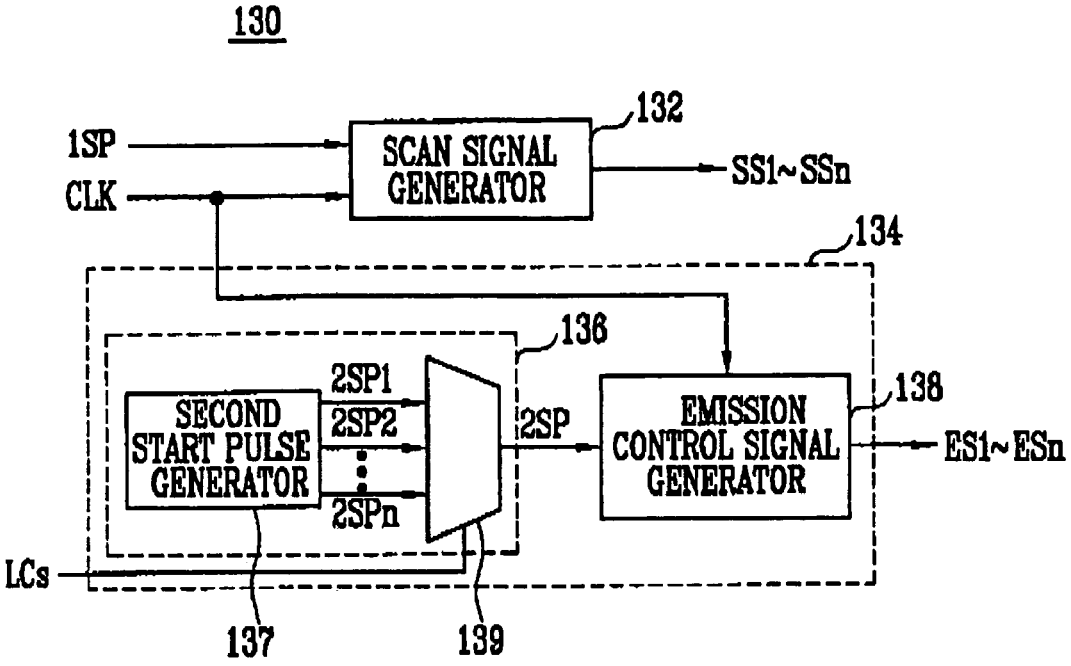
FIG. 3 illustrates a scan driver of FIG. 1.

FIG. 3 illustrates the scan driver 130 in the light emitting display of FIG. 1.

Referring to FIG. 3 in association with FIGS. 1 and 2, the scan driver 130 includes a scan signal generator 132 and an emission control signal generator 134.

The scan signal generator 132 sequentially shifts first start pulses 1SP supplied from the controller 150 according to a clock signal CLK, thereby generating scan signals SS1 through SSn to be supplied to the scan lines S1 through Sn in sequence.

The emission control signal supplier 134 includes a second start pulse supplier 136 and an emission control signal generator 138.

The second start pulse supplier 136 includes the second start pulse generator 137 and a selector 139.

The second start pulse generator 137 generates a second start pulse 2SP1 through 2SPn respectively having $1^{st}$ width through $n^{th}$ width that are different from each other, where n is a positive integer larger than 1, and supplies the second start pulses 2SP1 through 2SPn to the selector 139.

The selector 139 selects one of the second start pulses 2SP1 through 2SPn having different $1^{st}$ through $n^{th}$ widths supplied from the second start pulse generator 137 according to the brightness control signals LCs supplied from the comparator 158 of the brightness controller 154, and supplies the selected one of the second start pulses as a second start pulse 2SP to the emission control signal generator 138.

The emission control signal generator 138 sequentially shifts the second start pulse 2SP selected and supplied from the selector 139 according to the clock signals CLK, thereby generating the emission control signals ES1 through ESn supplied to the emission control lines E1 through En in sequence.

Alternatively, the scan signal generator 132 and the emission control signal supplier 134 may be provided separately from each other. Further, the second start pulse generator 137 of the emission control signal supplier 134 may be provided in the brightness controller 154 of the controller 150. This structure will be described with reference to FIGS. 4 and 5.

Figure 4:
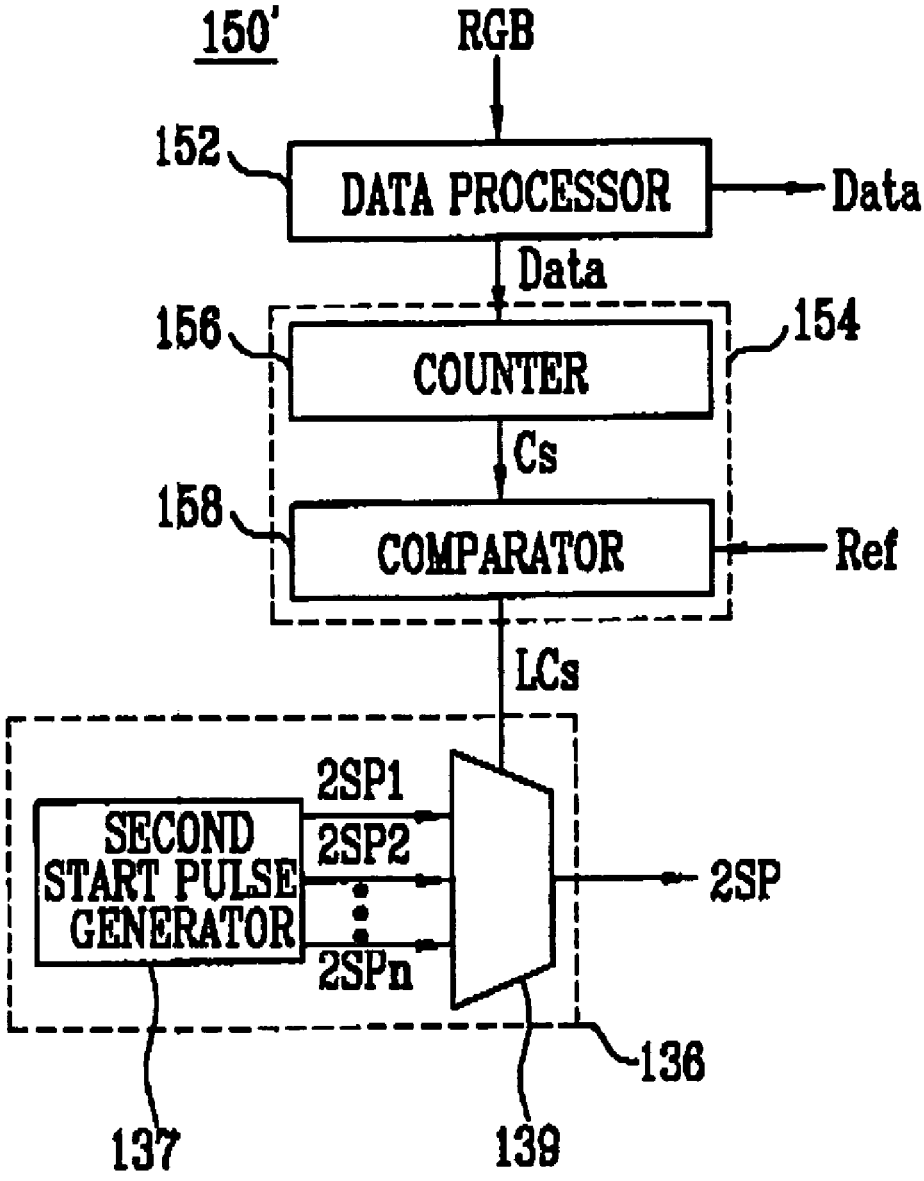
FIG. 4 illustrates a controller according to another exemplary embodiment of the present invention in association with FIG. 1.

FIG. 4 illustrates a controller according to another exemplary embodiment of the present invention in association with FIG. 1.

Referring to FIG. 4 in association with FIG. 1, a controller 150' according to the second exemplary embodiment of the present invention includes a data processor 152, a brightness controller 154, and a second start pulse supplier 136. The controller 150' may, for example, be used as the controller 150 of FIG. 1 together with a corresponding suitable scan driver.

The data processor 152 and the brightness controller 154 generate a brightness control signal LCs as described above with reference to FIG. 2.

The second start pulse generator 136 generates the second start pulse 2SP according to the brightness control signals LCs supplied from the brightness controller 154 as described above with reference to FIG. 3.

Figure 5:
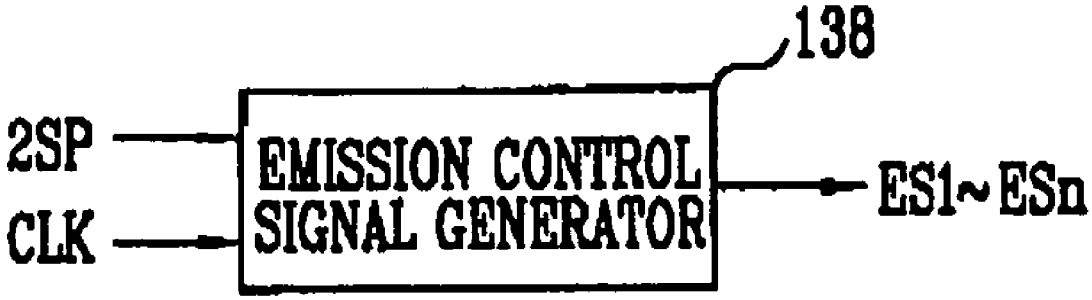
FIG. 5 illustrates an emission control signal generator of FIG. 1.

FIG. 5 illustrates the emission control signal generator 138 for driving the emission control lines E1 through En of FIG. 1.

Referring to FIG. 5 in association with FIG. 4, the emission control signal generator 138 sequentially shifts the second start pulse 2SP supplied from the second start pulse supplier 136 of the controller 150 in response to the clock signal CLK, thereby generating the emission control signals ES1 through ESn to be supplied to the emission control lines E1 through En in sequence.

Figure 6:
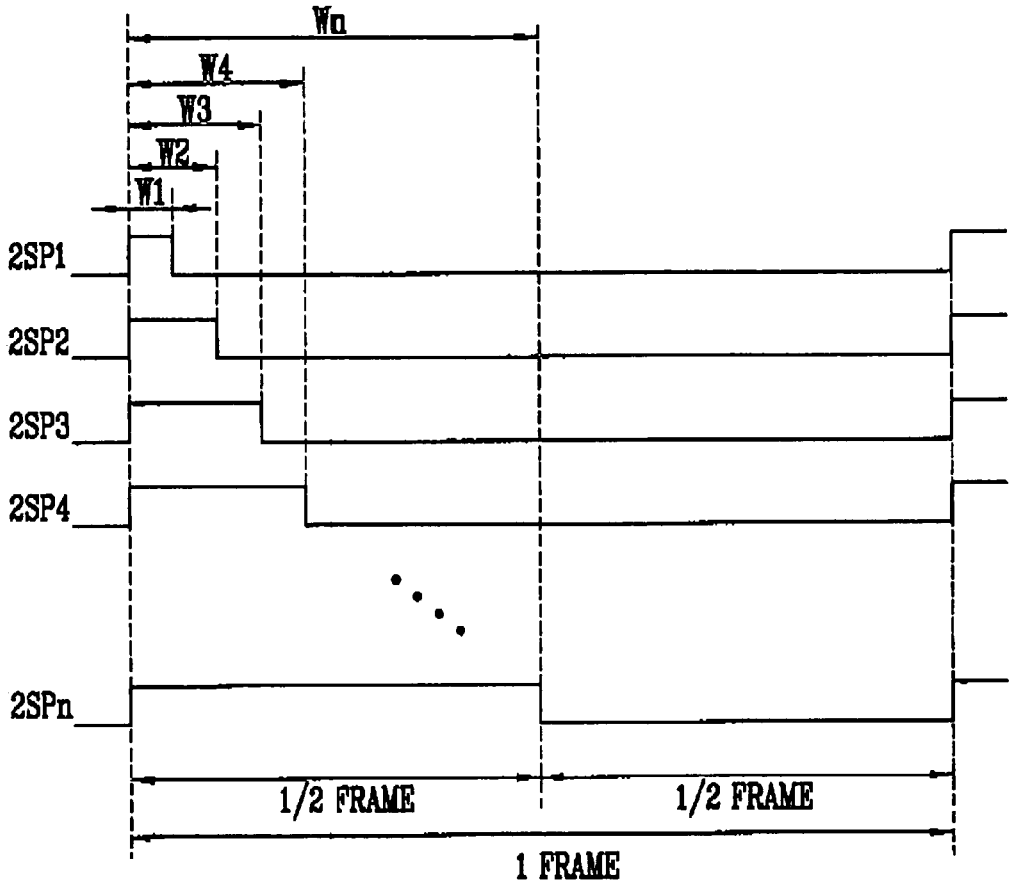
FIG. 6 illustrates waveforms of a second start pulse generated from a second start pulse generator in association with FIGS. 3 to 5.

FIG. 6 illustrates waveforms of the second start pulse 2SP (i.e., 2SP1 through 2SPn) outputted from the second start pulse generator 137 in association with FIGS. 3 and 5.

Referring to FIG. 6 in association with FIGS. 3 to 5, the second start pulse generator 137 generates the second start pulse 2SP1 through 2SPn having the pulse widths W1 through Wn that are different from each other. Here, the pulse width of the second start pulse 2SP increases as it comes near the $n^{th}$ width.

Figure 7:
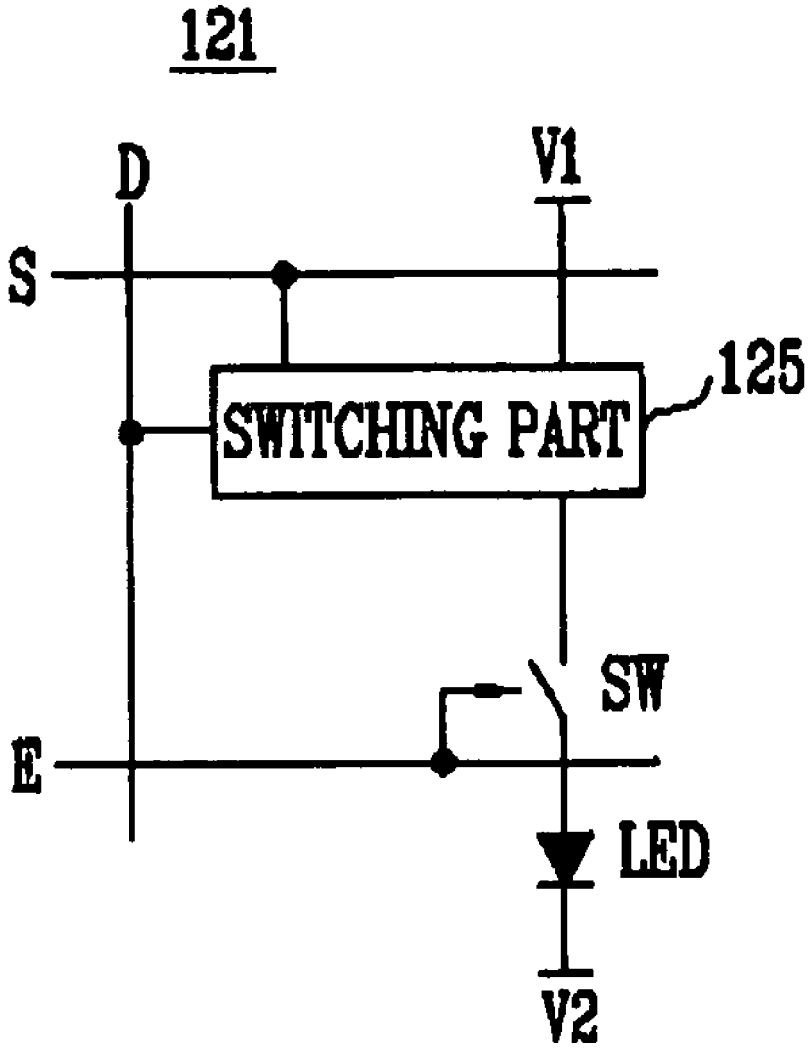
FIG. 7 is a circuit diagram of a pixel of FIG. 1.

FIG. 7 is a circuit diagram of one of the pixels 121 of FIG. 1.

Referring to FIG. 7 in association with FIGS. 3 to 5, each pixel 121 includes a light emitting device LED, a switching part 125, and a switching device SW.

The switching part 125 is connected to the data line D, the scan line S, a first power line V1, and the switching device SW. The switching part 125 outputs a current from the first power line V1 to the switching device SW in correspondence with the data signal transmitted to the data line D in response to the scan signal SS (e.g., one of scan signals SS1 through SSn) supplied from the scan signal generator 132. Here, the switching part 125 includes at least one transistor and at least one capacitor. Here, the transistor includes a p-type or n-type metal oxide semiconductor field effect transistor (MOSFET).

The switching device SW supplies the current from the switching part 125 to the light emitting device LED in correspondence with the emission control signals ES1 through ESn having low-level supplied from the emission control signal generator 138 to the emission control line E. Further, the switching device SW cuts off a current path between the switching part 125 and the light emitting device LED for a period when the scan signals SS1 through SSn are supplied to the switching part 125, but forms the current path between the switching part 125 and the light emitting device LED for the other period.

The light emitting device LED includes an anode electrode connected to an output terminal of the switching device SW, and a cathode electrode connected to a second power line V2. In the case of the p-type transistor, the second power line V2 has a voltage level lower than that of the first power line V1, and may have a ground voltage level. On the other hand, in the case of n-type transistor, the second power line V2 may have a voltage level higher than that of the first power line V1.

Thus, the light emitting device LED emits light corresponding to the amount of current transmitted from the switching device SW. Here, the light emitting device LED includes an organic light emitting device. The organic light emitting device includes an organic emitting layer provided between an anode electrode and a cathode electrode, an electron transport layer, and a hole transport layer. Additionally, the organic light emitting device may include an electron injection layer and a hole injection layer. In the organic light emitting device, when a voltage is applied between the anode electrode and the cathode electrode, electrons generated from the cathode electrode are moved to the emitting layer via the electron injection layer and the electron transport layer, and holes generated from the anode electrode are moved to the emitting layer via the hole injection layer and the hole transport layer. Then, the electrons from the electron transport layer and the holes from the hole transport layer are recombined in the emitting layer, thereby emitting the light.

The light emitting device LED emits light corresponding to the amount of current transmitted via the switching device SW while the emission control signals ES1 through ESn having low-level are transmitted to the emission control line (e.g., emission control lines E1 through En) in one frame to display an image.

Figure 8:
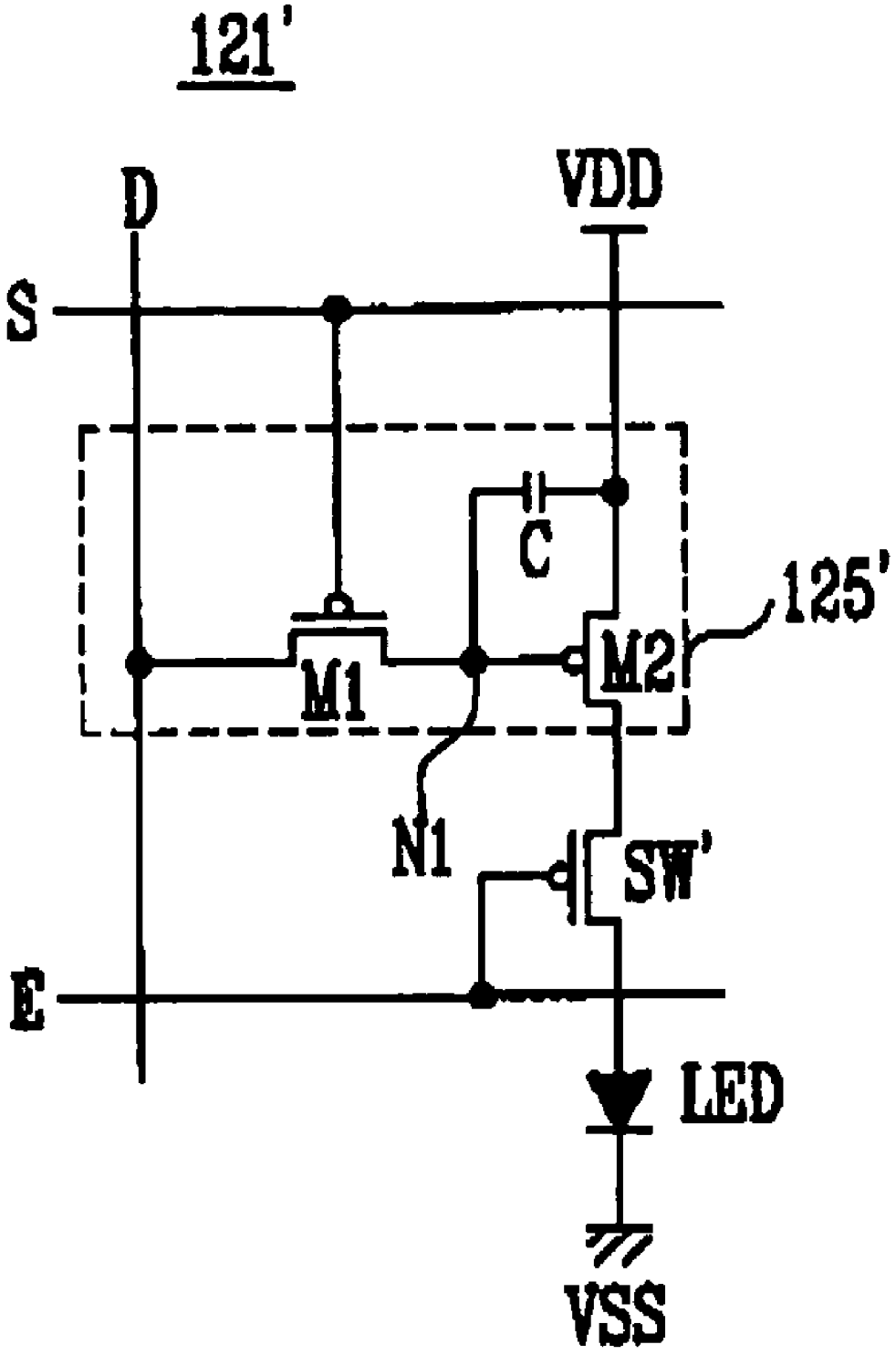
FIG. 8 is a circuit diagram of a pixel including a p-type transistor in a light emitting display according to a first exemplary embodiment of the present invention.

FIG. 8 is a circuit diagram of a pixel 121' that includes p-type transistors in a light emitting display according to a first exemplary embodiment of the present invention. The pixel 121' may be used as the pixel 121 of FIGS. 1 and 7, for example. In other embodiments, the pixel 121 may include N-type transistors or any other suitable transistors.

Referring to FIG. 8 in association with FIGS. 3 to 5, the pixel 121' includes a light emitting device LED, a switching part 125', and a switching device SW'.

The switching part 125' includes a first transistor M1, a second transistor M2, and a capacitor C.

The first transistor M1 includes a gate electrode connected to the scan line S, a source electrode connected to the data line D, and a drain electrode connected to a first node N1. The first transistor M1 supplies the data signal from the data line D to the first node N1 in response to the scan signal transmitted to the scan line S.

The capacitor C stores voltage corresponding to the data signal transmitted to the first node N1 via the first transistor M1 while the scan signal is transmitted to the scan line S, and maintains a turned-on state of the second transistor M2 during one frame when the first transistor M1 is turned off.

The second transistor M2 includes a gate electrode connected to the first node N1 to which the drain electrode of the first transistor M1 and the capacitor C are commonly connected, a source electrode connected to a first power line VDD, and a drain electrode coupled through the switching device SW' to an anode electrode of the light emitting device LED. The second transistor M2 adjusts the amount of current transmitted from the first power line VDD to the light emitting device LED according to the data signals.

The switching device SW' includes a p-type transistor that includes a gate electrode connected to the emission control line E, a source electrode connected to the drain electrode of the second transistor M2, and a drain electrode connected to the anode electrode of the light emitting device LED. The switching device SW' supplies the current from the second transistor M2 to the anode electrode of the light emitting device in response to the emission control signal supplied to the emission control line E.

The light emitting device LED emits light based on the amount of current supplied from the second transistor M2 via the switching device SW' while the switching device SW' is turned on.

Thus, in the light emitting display according to the first exemplary embodiment of the present invention and the driving method thereof, each pixel 121 or 121' emits light in a normal mode in accordance with the brightness control signal LCs generated from the comparator 158 when the count signal Cs is lower than the preset reference value Ref.

On the other hand, in the light emitting display according to the first exemplary embodiment of the present invention and the driving method thereof, each pixel 121 or 121' emits light in a brightness limitation mode in accordance with the brightness control signal LCs generated from the comparator 158 when the count signal Cs is higher than the preset reference value Ref, thereby decreasing the brightness of the image displaying part 120. Here, the brightness limitation mode can be divided into a manual mode and an automatic mode according to user's setting.

In the manual mode of the brightness limitation mode, the brightness of the image displaying part 120 corresponding to the preset reference value Ref is decreased on the basis of the emission control signal ES transmitted to the emission control line E generated using the second start pulse 2SP2 through 2SPn having one of the $2^{nd}$ width W2 through the $n^{th}$ width Wn selected according to the brightness control signal LCs. Thus, the brightness of the image displaying part 120 is decreased by a unit of 5% within a range from 5% through 50% on the basis of each emission control signal ES generated using the second start pulse 2SP2 through 2SPn having one of the $2^{nd}$ width W2 through the $n^{th}$ width Wn selected according to the brightness control signal LCs. As a result, the brightness of the image displaying part 120 is decreased within the range from 5% to 50% in the manual mode of the brightness limitation mode.

In the automatic mode of the brightness limitation mode, the emission control signal ES is generated and supplied to the emission control line E on the basis of the second start pulses 2SP2 through 2SPn having the set width among the $2^{nd}$ width W2 through the $n^{th}$ width Wn according to the brightness control signal LCs. Thus, each emission control signal ES generated on the basis of the second start pulses 2SP2 through 2SPn having the set width among the $2^{nd}$ width W2 through the $n^{th}$ width Wn decreases the brightness of the image displaying part 120 by one percentage within the range from 5% to 50%. As a result, the brightness of the image displaying part 120 is decreased by the set percentage in the automatic mode of the brightness limitation mode.

Figure 9:
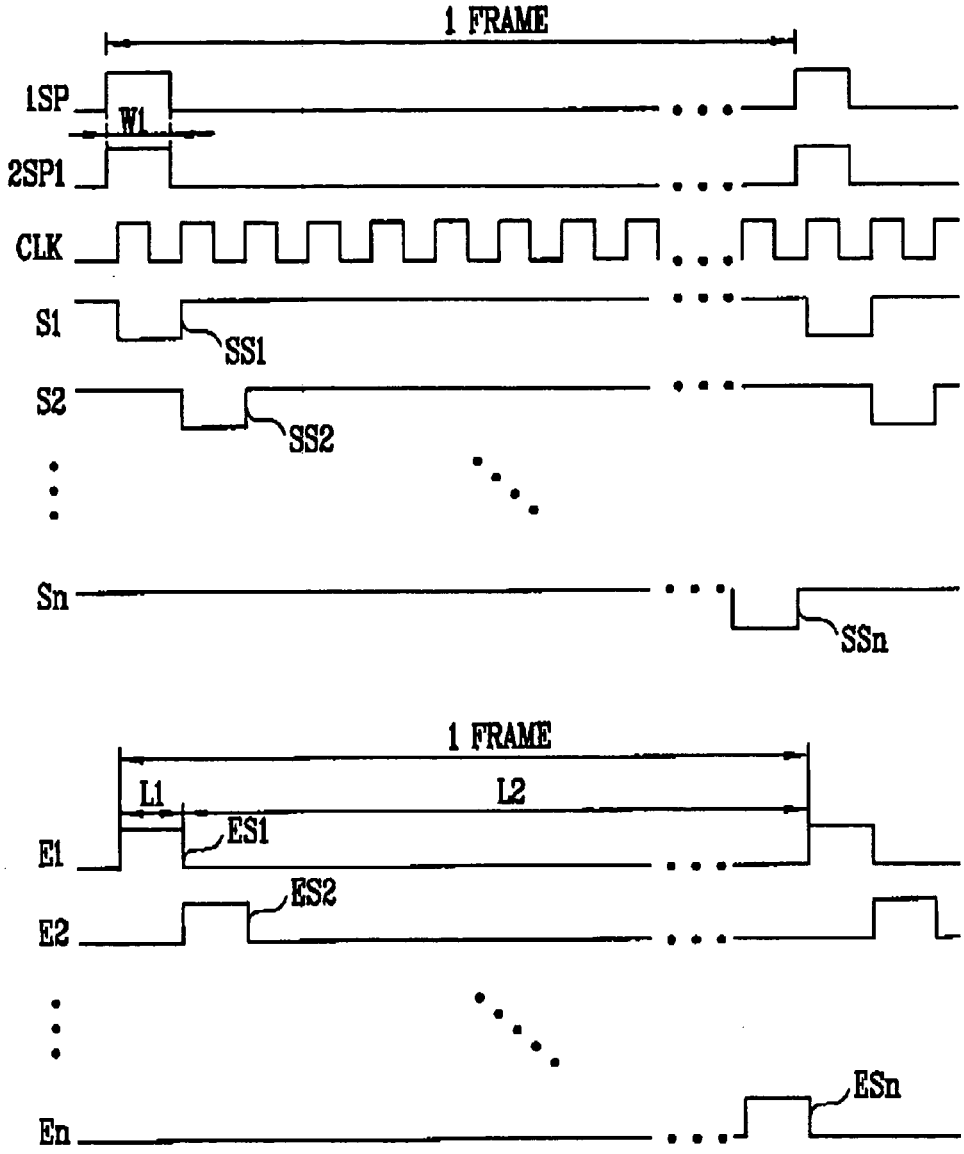
FIG. 9 illustrates waveforms of signals for driving the light emitting display according to the first exemplary embodiment of the present invention in a normal mode.

FIG. 9 illustrates waveforms of signals for driving the light emitting display according to the first exemplary embodiment of the present invention in a normal mode.

Referring to FIG. 9 in association with FIG. 8, the scan signal SS (i.e., SS1 through SSn) is generated by shifting the first start pulse 1SP in sequence according to the clock signal CLK, thereby being supplied to the scan lines S (i.e., S1 through Sn). Further, in the normal mode, the emission control signal is generated by shifting the second start pulse 2SP1 having the $1^{st}$ width W1 in sequence according to the clock signal CLK, and is supplied to the emission control lines E, wherein the second start pulse 2SP1 has the $1^{st}$ width W1 selected by the brightness control signal LCs corresponding to the number of white signals in the digital video data Data which is smaller than the reference value.

In the normal mode, the light emitting display and the driving method thereof are as follows.

First, the scan signals SS1 through SSn having low-level are transmitted to the scan lines S1 through Sn in sequence, and at the same time, the emission control signal ES1 through ESn having high-level generated by the second start pulse 2SP1 having the $1^{st}$ width W1 are transmitted to the emission control lines E1 through En in sequence. Therefore, the first transistor M1 connected to the scan lines S1 through Sn is turned on, and the switching device SW' connected to the emission control lines E1 through En is turned off. Thus, the data signal supplied from the data line D is supplied to the gate electrode of the second transistor M2 via the first transistor M1 and the first node N1. Hence, the second transistor M2 is turned on by the voltage applied to the first node N1, and outputs the current corresponding to the data signal. However, the current outputted from the second transistor M2 is cut off by the switching device SW' being in the turned-off state. At this time, the capacitor C stores a voltage corresponding to a difference between the voltage applied to the gate electrode of the second transistor M2 and the voltage of the first power line VDD.

Then, the scan signals SS (i.e., SS1 through SSn) having high-level are supplied to the scan lines S (i.e., S1 through Sn) in sequence, and at the same time, the emission control signals ES (i.e., ES1 through ESn) having low-level are supplied to the emission control lines E (i.e., E1 through En) in sequence. Thus, the first transistors M1 connected to the scan lines S1 through Sn are turned off, and at the same time, the switching device SW' connected to the emission control lines E1 through En are turned on. Therefore, the second transistor M2 remains turned on by the voltage corresponding to the data signal stored in the capacitor C, so that the current corresponding to the data signal is supplied to the switching device SW'. Further, the switching device SW' is turned on by the emission control signal ES having low-level, and supplies the current from the second transistor M2 to the light emitting device LED. Thus, the light emitting device LED emits light for a period L2 of one frame excluding a period L1 during which the emission control signal ES having high-level is supplied, thereby displaying an image.

In the light emitting display operating in the normal mode and the driving method thereof, the number of the white signals in the digital video data Data supplied to the image displaying part 120 is smaller than the reference value Ref, so that the power supply 160 is not overloaded by the emission of each pixel 121 or 121'.

Figure 10:
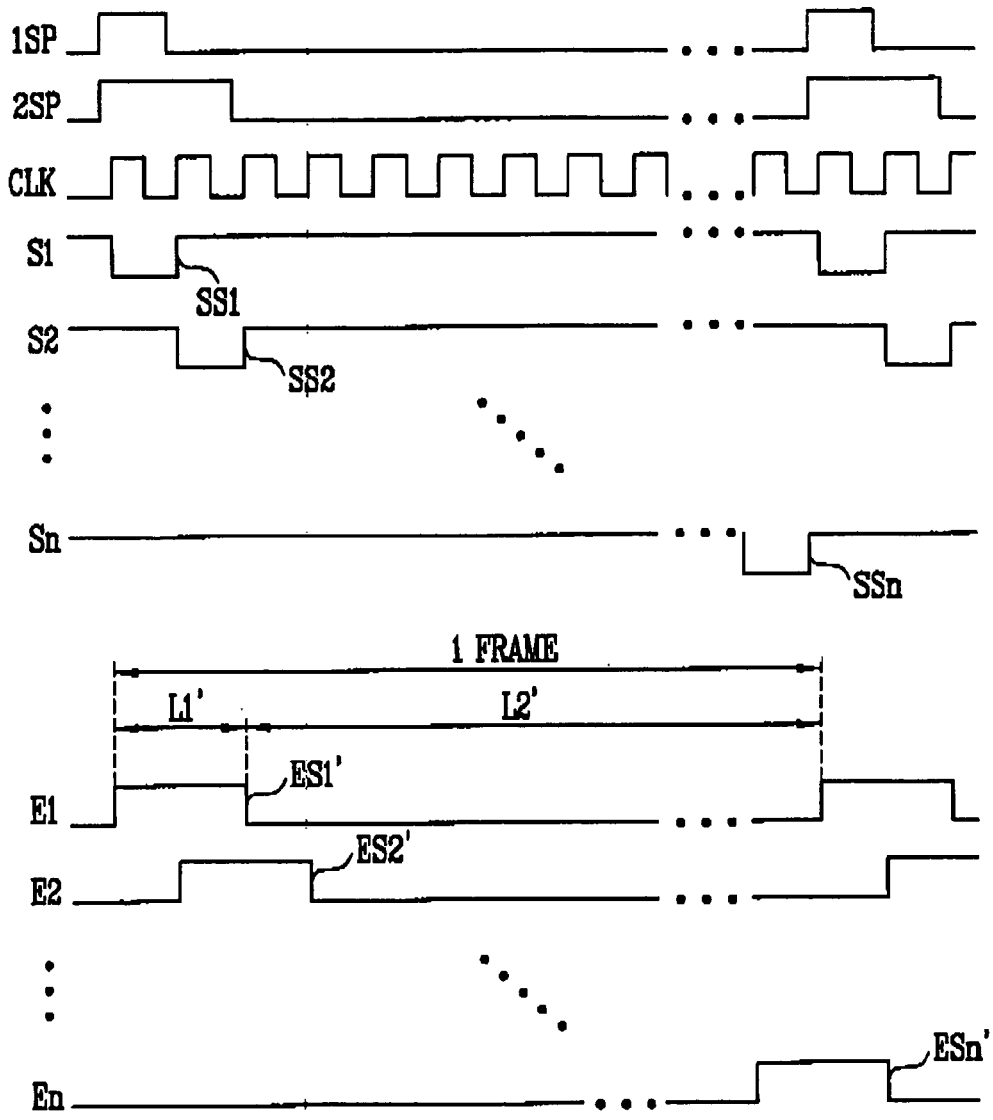
FIG. 10 illustrates waveforms of the signals for driving the light emitting display according to the first exemplary embodiment of the present invention in a brightness limitation mode.

FIG. 10 illustrates waveforms of the signals for driving the light emitting display according to the first exemplary embodiment of the present invention in a brightness limitation mode.

Referring to FIG. 10 in association with FIG. 8, the scan signal SS (i.e., SS1 through SSn) is generated by shifting the first start pulse 1SP in sequence according to the clock signal CLK, thereby being supplied to the scan lines S. Further, in the brightness limitation mode, the emission control signal ES' (i.e., ES1' through ESn') is generated by shifting the second start pulse 2SP having a certain width in sequence according to the clock signal CLK, and is supplied to the emission control lines E, wherein the second start pulse 2SP (e.g., one of 2SP2 through 2SPn) has one of the $2^{nd}$ width W2 through the $n^{th}$ width Wn selected by the brightness control signal LCs corresponding to the number of white signals in the digital video data Data which is larger than the reference value. In FIG. 10, for example, the second start pulse 2SP can be the second start pulse 2SP2 having the $2^{nd}$ width W2.

In the brightness limitation mode, the light emitting display and the driving method thereof are as follows.

First, the scan signals SS1 through SSn having low-level are transmitted to the scan lines S1 through Sn in sequence, and at the same time, the emission control signal ES1' through ESn' having high-level generated by the second start pulse 2SP2 having the $2^{nd}$ width W2 are transmitted to the emission control lines E1 through En in sequence. Therefore, the first transistor M1 connected to the scan lines S1 through Sn is turned on, and the switching device SW' connected to the emission control lines E1 through En is turned off. Thus, the data signal supplied from the data line D is supplied to the gate electrode of the second transistor M2 via the first transistor M1 and the first node N1. Hence, the second transistor M2 is turned on by the voltage applied to the first node N1, and outputs the current corresponding to the data signal. However, the current outputted from the second transistor M2 is cut off by the switching device SW' being in the turned-off state. At this time, the capacitor C stores a voltage corresponding to a difference between the voltage applied to the gate electrode of the second transistor M2 and the voltage of the first power line VDD.

Then, the scan signals SS (i.e., SS1 through SSn) having high-level are supplied to the scan lines S (i.e., S1 through Sn) in sequence, and at the same time, the emission control signals ES' (i.e., ES1' through ESn') having low-level are supplied to the emission control lines E (i.e., E1 through En) in sequence. Thus, the first transistors M1 connected to the scan lines S1 through Sn are turned off, and at the same time, the switching devices SW' connected to the emission control lines E1 through En are turned on. Therefore, the second transistor M2 remains turned on by the voltage corresponding to the data signal stored in the capacitor C, so that the current corresponding to the data signal is supplied to the switching device SW'. Further, the switching device SW' is turned on by the emission control signal ES' having low-level, and supplies the current from the second transistor M2 to the light emitting device LED. Thus, the light emitting device LED emits light for a period L2' of one frame excluding a period L1' during which the emission control signal ES' having high-level is supplied, thereby displaying an image. In the brightness limitation mode, the emission control signal ES' generated by the second start pulse 2SP2 having the $2^{nd}$ width causes the brightness of one frame due to the emission of the light emitting device LED to be decreased by about 5% as compared with the normal mode.

In the light emitting display operating in the brightness limitation mode and the driving method thereof, the number of white signals in the digital video data Data supplied to the image displaying part 120 is larger than the reference value Ref, so that the emitting period of each pixel 121 or 121' is shortened by about 5% as compared with the normal mode. Further, in the light emitting display operating in the brightness limitation mode and the driving method thereof, the brightness of the image displaying part 120 is decreased by about 5% using the emission control signal ES', so that the power supply 160 is prevented from being overloaded when the number of white signals in the digital video data Data supplied to the image displaying part 120 is larger than the reference value Ref.

In the light emitting display according to the first exemplary embodiment of the present invention and the driving method thereof, the brightness of the image displaying part 120 is decreased by one percentage among 5%, 10%, 15%, 20%, 25%, 30%, 35%, 40%, 45% and 50%, according to the number of white signals in the digital video data Data in the manual mode of the brightness limitation mode when the number of white signals of the digital video data Data supplied to the image displaying part 120 is larger than the reference value Ref.

Further, in the light emitting display according to the first exemplary embodiment of the present invention and the driving method thereof, the brightness of the image displaying part 120 is decreased by one preset percentage among 5%, 10%, 15%, 20%, 25%, 30%, 35%, 40%, 45% and 50% in the automatic mode of the brightness limitation mode when the number of white signals in the digital video data Data supplied to the image displaying part 120 is larger than the reference value Ref.

Figure 11:
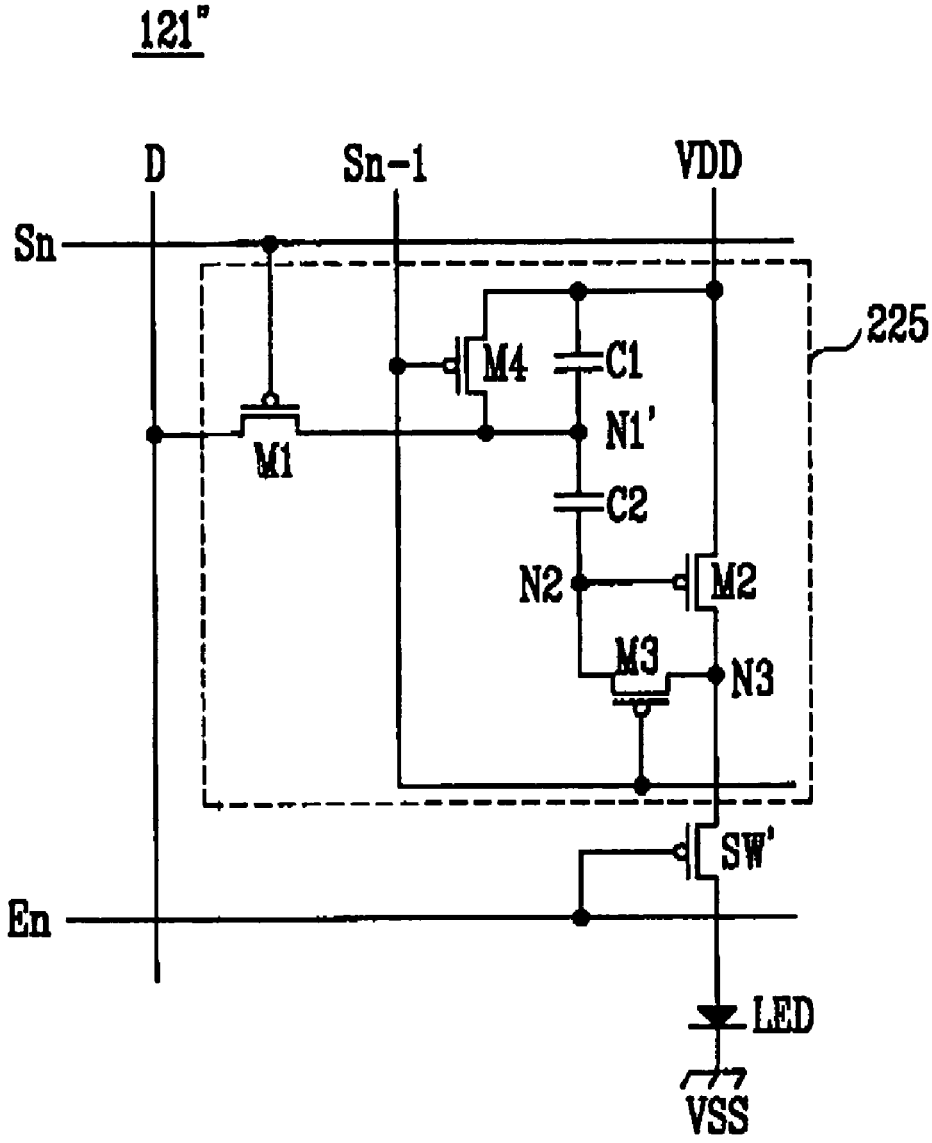
FIG. 11 is a circuit diagram of a pixel including a p-type transistor in a light emitting display according to a second exemplary embodiment of the present invention.

FIG. 11 is a circuit diagram of a pixel including a p-type transistor in a light emitting display according to a second exemplary embodiment of the present invention.

Referring to FIG. 11 in association with FIGS. 3 to 5, a pixel 121" includes a light emitting device LED, a switching part 225, and a switching device SW'. The pixel 121" may be used, for example, as the pixel 121 of FIGS. 1 and 7.

The switching part 225 includes first through fourth transistors M1, M2, M3 and M4, and first and second capacitors C1 and C2.

The first transistor M1 includes a gate electrode connected to an $n^{th}$ scan line Sn, a source electrode connected to a data line D, and a drain electrode connected to a first node N1'. Here, the first transistor M1 supplies the data signal from the data line D to the first node N1' in response to a first scan signal transmitted to the $n^{th}$ scan line Sn.

The second transistor M2 includes a gate electrode connected to a second node N2, a source electrode connected to a first power line VDD, and a drain electrode connected to the switching device SW' via a third node N3. Here, the second transistor M2 outputs a current corresponding to a voltage applied between the gate and source electrodes thereof from the first power line VDD.

The third transistor M3 includes a gate electrode connected to an $(n-1)^{th}$ scan line Sn−1, a source electrode connected to the second node N2, and a drain electrode connected to the third node N3. Here, the third transistor M3 makes the second transistor M2 be connected like a diode in response to the second scan signal supplied to the $(n-1)^{th}$ scan line Sn−1.

The fourth transistor M4 includes a gate electrode connected to the $(n-1)^{th}$ scan line Sn−1, a source electrode connected to the first power line VDD, and a drain electrode connected to the first node N1'. Here, the fourth transistor M4 supplies the power from the first power line VDD to the first node N1' in response to the second scan signal supplied to the $(n-1)^{th}$ scan line Sn−1.

The first capacitor C1 includes a first electrode connected to the first power line VDD, and a second electrode connected to the first node N1'. Here, the first capacitor C1 stores the data signal supplied to the first node N1' via the first transistor M1 while the first scan signal is supplied to the $n^{th}$ scan line Sn, and supplies the stored voltage to the gate electrode of the second transistor M2 when the first transistor M1 is turned off.

The second capacitor C2 stores a voltage corresponding to a threshold voltage Vth of the second transistor M2 from the first power line VDD while the second scan signal is supplied to the $(n-1)^{th}$ scan line Sn−1. That is, the second capacitor C2 stores a compensation voltage for compensating the threshold voltage Vth of the second transistor M2 according to on/off state of third and fourth transistors M3 and M4.

The switching device SW' includes a p-type transistor including a gate electrode connected to the emission control line E, a source electrode connected to the drain electrode of the second transistor M2, and a drain electrode connected to an anode electrode of the light emitting device LED. Here, the switching device SW' supplies the current from the second transistor M2 to the anode electrode of the light emitting device LED in response to the emission control signal supplied to the emission control line E.

The light emitting device LED includes the anode electrode connected to the output terminal of the switching device SW', and a cathode electrode connected to a second power line VSS. Here, the light emitting device LED emits light corresponding to the current supplied from the second transistor M2 via the switching device SW' while the switching device SW' is turned on.

Thus, in the light emitting display according to the second exemplary embodiment of the present invention and the driving method thereof, the threshold voltage Vth of the second transistor M2 is compensated, and the brightness of the image displaying part 120 is decreased according to the number of white signals in the digital video data Data supplied to the image displaying part 120 in the same manner as used in the first exemplary embodiment of the present invention.

Figure 12:
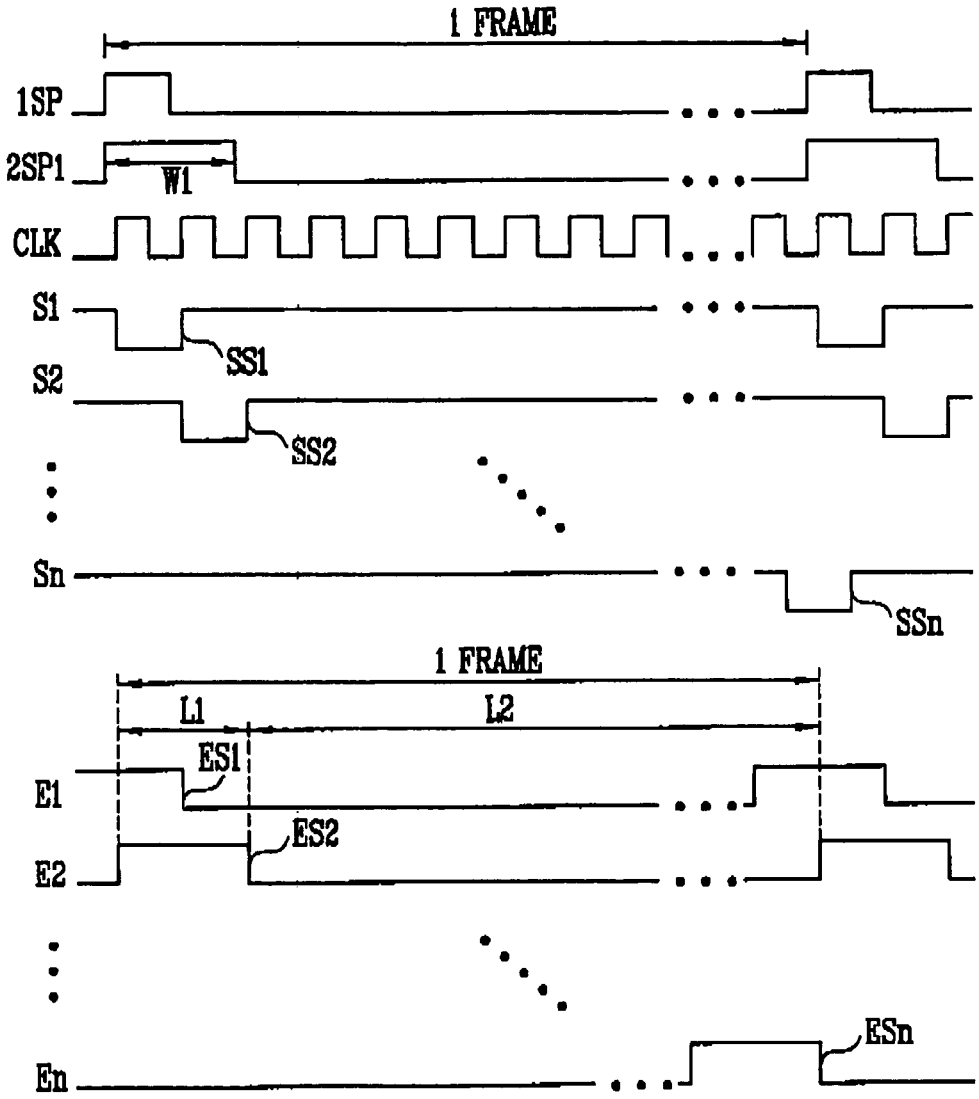
FIG. 12 illustrates waveforms of signals for driving the light emitting display according to the second exemplary embodiment of the present invention in a normal mode.

FIG. 12 illustrates waveforms of signals for driving the light emitting display according to the second exemplary embodiment of the present invention in a normal mode.

Referring to FIG. 12 in association with FIG. 11, the scan signal SS (i.e., SS1 through SSn) is generated by shifting the first start pulse 1SP in sequence according to the clock signal CLK, thereby being supplied to the scan lines S (i.e., S1 through Sn). Further, in the normal mode, the emission control signal is generated by shifting the second start pulse 2SP1 having the $1^{st}$ width W1 in sequence according to the clock signal CLK, and is supplied to the emission control lines E, wherein the second start pulse 2SP1 has the $1^{st}$ width W1 selected by the brightness control signal LCs corresponding to the number of white signals in the digital video data Data which is smaller than the reference value.

In the normal mode, the light emitting display and the driving method thereof are as follows.

First, the second scan signal SS (i.e., SS1 through SSn) having low-level is transmitted to the previous scan lines Sn−1 in sequence, and at the same time, the emission control signal ES1 through ESn having high-level generated by the second start pulse 2SP1 having the $1^{st}$ width W1 are transmitted to the emission control lines E1 through En in sequence. Therefore, the third and fourth transistors M3 and M4 connected to the scan lines Sn−1 are turned on, and the switching device SW' connected to the emission control lines E1 through En is turned off. Thus, the second transistor M2 functions as the diode, and the voltage applied to the gate of the second transistor M2 varies until it is equal to the threshold voltage of the second transistor M2. Therefore, the second capacitor C2 stores the voltage corresponding to the threshold voltage Vth of the second transistor M2.

Then, the first scan signal SS (i.e., SS1 through SSn) having low-level is supplied to the present scan lines Sn in sequence, but the emission control signals ES1 through ESn supplied to the emission control lines E1 through En are maintained at high-level. Thus, the first transistor M1 connected to the scan lines Sn is turned on, and the switching device SW' connected to the emission control lines E1 through En remains turned off. Therefore, the data signal supplied to the data line D is supplied to the first node N1' via the first transistor M1. Further, the second transistor M2 is turned on by a voltage variance Vdata-VDD of the first node N1' and the voltage stored in the second capacitor C2, and outputs the current corresponding to the voltage applied between the gate and source electrodes thereof from the first power line VDD. However, the current outputted from the second transistor M2 is cut off by the switching device SW' that is turned off. At this time, the first capacitor C1 stores a voltage corresponding to a difference between the voltage applied to the gate electrode of the second transistor M2 and the voltage of the first power line VDD.

Then, the scan signals SS (i.e., SS1 through SSn) having high-level are supplied to the present scan lines Sn, and at the same time, the emission control signals ES (i.e., ES1 through ESn) having low-level are supplied to the switching device SW'. Thus, the first transistors M1 connected to the present scan lines Sn are turned off, and at the same time, the switching devices SW' are turned on. Therefore, the second transistor M2 remains turned on by the voltage stored in the first capacitor C1, so that the current corresponding to the data signal is supplied to the switching device SW'. Further, the switching device SW' is turned on by the emission control signal ES having low-level, and supplies the current from the second transistor M2 to the light emitting device LED. Thus, the light emitting device LED emits light for a period L2 of one frame excluding a period L1 during which the emission control signal ES having high-level is supplied, thereby displaying an image. The period of L1 (the width W1 of 2SP1) may be variously set according to the structure of the pixel. By way of example, for the pixel 121" of FIG. 11, the period of L1 may be overlapped with at least two low-level scan signals (e.g., SS1 and SS2 as shown in FIG. 12).

In the light emitting display operating in the normal mode and the driving method thereof, the number of white signals in the digital video data Data supplied to the image displaying part 120 is smaller than the reference value Ref, so that the power supply 160 is not overloaded by the emission of each pixel 121 or 121".

Figure 13:
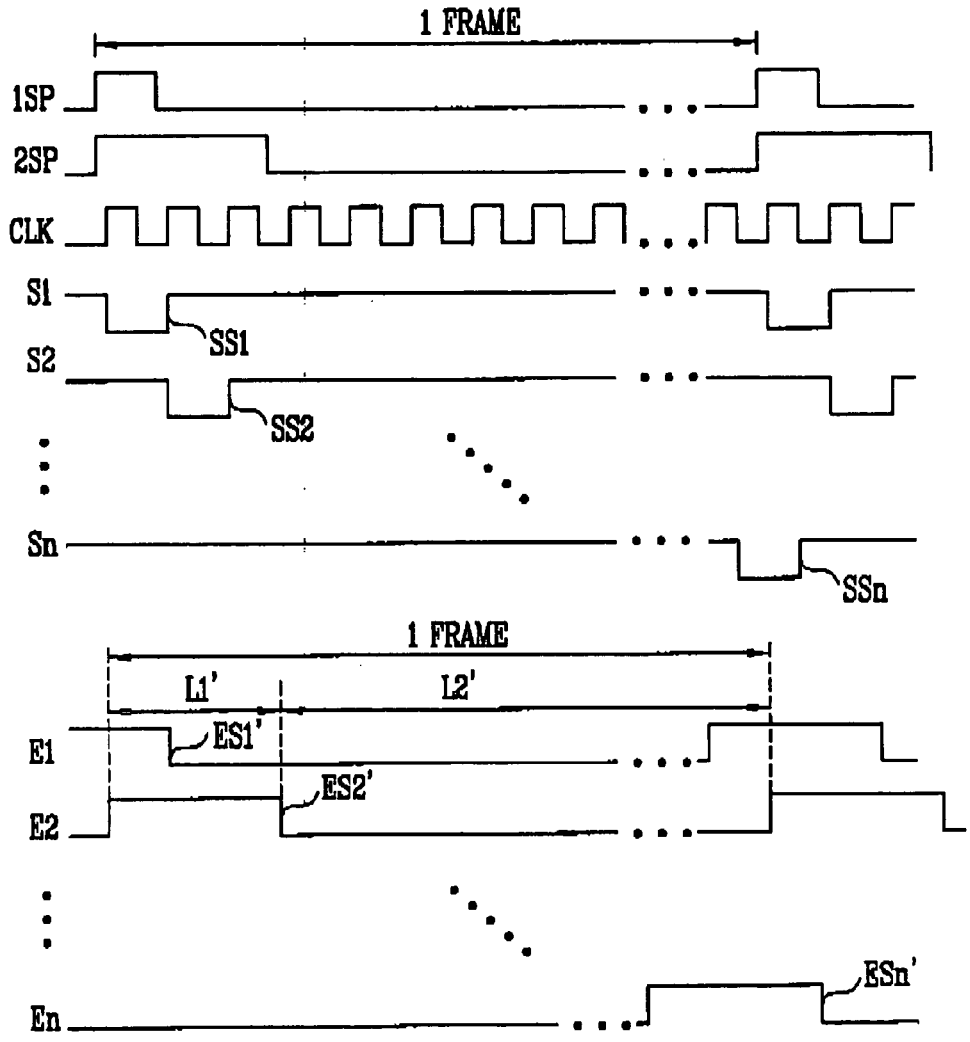
FIG. 13 illustrates waveforms of the signals for driving the light emitting display according to the second exemplary embodiment of the present invention in a brightness limitation mode.

FIG. 13 illustrates waveforms of the signals for driving the light emitting display according to the second exemplary embodiment of the present invention in a brightness limitation mode.

Referring to FIG. 13 in association with FIG. 11, the scan signal SS (i.e., SS1 though SSn) is generated by shifting the first start pulse 1SP in sequence according to the clock signal CLK, thereby being supplied to the scan lines S (i.e., S1 through Sn). Further, in the normal mode, the emission control signal is generated by shifting a second start pulse 2SP in sequence according to the clock signal CLK and is supplied to the emission control lines E (i.e., E1 through En), wherein the second start pulse 2SP has one of the $2^{nd}$ width W2 through the $n^{th}$ width Wn selected by the brightness control signal LCs corresponding to the number of white signals in the digital video data Data which is larger than the reference value. By way of example, the second start pulse 2SP2 illustrated in FIG. 13 may be the second start pulse 2SP2 have the $2^{nd}$ width W2.

In the brightness limitation mode, the light emitting display and the driving method thereof are as follows.

First, the second scan signals SS (i.e., SS1 through SSn) having low-level are transmitted to the previous scan lines Sn−1 in sequence, and at the same time, the emission control signal ES1' through ESn' having high-level generated by the second start pulse 2SP2 having the $2^{nd}$ width W2 are transmitted to the emission control lines E1 through En in sequence. Therefore, the third and fourth transistors M3 and M4 connected to the previous scan lines Sn−1 are turned on, and the switching device SW' connected to the emission control lines E1 through En is turned off. Thus, the second transistor M2 functions as the diode, and the voltage applied to the gate of the second transistor M2 varies until it is equal to the threshold voltage of the second transistor M2. Therefore, the second capacitor C2 stores the voltage corresponding to the threshold voltage Vth of the second transistor M2.

Then, the first scan signal SS (i.e., SS1 through SSn) having low-level is supplied to the present scan lines Sn in sequence, but the emission control signals ES1' through ESn' supplied to the emission control lines E1 through En remain at high-level. Thus, the first transistor M1 connected to the scan lines Sn is turned on, and the switching devices SW' connected to the emission control lines E1 through En remain turned off. Therefore, the data signal supplied to the data line D is supplied to the first node N1' via the first transistor M1. Further, the second transistor M2 is turned on by a voltage variance Vdata-VDD of the first node N1' and the voltage stored in the second capacitor C2, and outputs the current corresponding to the voltage applied between the gate and source electrodes thereof from the first power line VDD. However, the current outputted from the second transistor M2 is cut off by the switching device SW' that is turned off. At this time, the first capacitor C1 stores a voltage corresponding to a difference between the voltage applied to the gate electrode of the second transistor M2 and the voltage of the first power line VDD.

Then, the scan signals SS (i.e., SS1 through SSn) having high-level are supplied to the present scan lines Sn in sequence, and at the same time, the emission control signals ES' (i.e., ES1' through ESn') having low-level are supplied to the switching device SW'. Thus, the first transistors M1 connected to the present scan lines Sn are turned off, and at the same time, the switching device SW' is turned on. Therefore, the second transistor M2 remains turned on by the voltage stored in the first capacitor C1, so that the current corresponding to the data signal is supplied to the switching device SW'. Further, the switching device SW' is turned on by the emission control signal ES' having low-level, and supplies the current from the second transistor M2 to the light emitting device LED. Thus, the light emitting device LED emits light for a period L2' of one frame excluding a period L1' during which the emission control signal ES' of the high state is supplied, thereby displaying an image. In the brightness limitation mode, the emission control signal ES' generated by the second start pulse 2SP2 having the $2^{nd}$ width W2 causes the brightness of one frame due to the emission of the light emitting device LED to be decreased by about 5% as compared with the normal mode.

In the light emitting display operating in the brightness limitation mode and the driving method thereof, the number of white signals in the digital video data Data supplied to the image displaying part 120 is larger than the reference value Ref, so that the emitting period of each pixel 121" is shortened by about 5% as compared with the normal mode. Further, in the light emitting display operating in the brightness limitation mode and the driving method thereof, the brightness of the image displaying part 120 is decreased by about 5% using the emission control signal ES', so that the power supply 160 is prevented from being overloaded when the number of white signals in the digital video data Data supplied to the image displaying part 120 is larger than the reference value Ref.

In the light emitting display according to the second exemplary embodiment of the present invention and the driving method thereof, the brightness of the image displaying part 120 is decreased by one percentage among 5%, 10%, 15%, 20%, 25%, 30%, 35%, 40%, 45% and 50%, according to the number of white signals in the digital video data Data in the manual mode of the brightness limitation mode when the number of white signals in the digital video data Data supplied to the image displaying part 120 is larger than the reference value Ref.

Further, in the light emitting display according to the second exemplary embodiment of the present invention and the driving method thereof, the brightness of the image displaying part 120 is decreased by one preset percentage among 5%, 10%, 15%, 20%, 25%, 30%, 35%, 40%, 45% and 50% in the automatic mode of the brightness limitation mode when the number of white signals in the digital video data Data supplied to the image displaying part 120 is larger than the reference value Ref.

As described above, the exemplary embodiments of the present invention provide a light emitting display and a driving method thereof, in which respective emitting periods of pixels are shortened according to the number of white signals supplied to an image displaying part, so that a power supply is prevented from being overloaded, thereby protecting electric and electronic components from damage and preventing the power supply from abnormally operating. According to the exemplary embodiments of the present invention, the brightness of the image displaying part is decreased while maintaining white balance uniformly, thereby protecting the power supply from being overloaded.

Further, the exemplary embodiments of the present invention provide a light emitting display and a driving method thereof, in which the brightness of a light emitting device is limited so as to prevent exceeding the brightness in proportion to an area corresponding to the light emitting device which is turned on, so that the brightness of the light emitting devices is prevented from wastefully increasing, thereby reducing power consumption and lengthening the lifespan of the light emitting device.

Although certain exemplary embodiments of the present invention have been shown and described, it would be appreciated by those skilled in the art that changes might be made in the described embodiments without departing from the principles and spirit of the invention, the scope of which is defined in the claims and their equivalents.

What is claimed is:

1. A light emitting display comprising:

an image displaying part comprising a plurality of pixels electrically connected to a plurality of scan lines, a plurality of data lines, and a plurality of emission control lines;

a controller adapted to generate a start signal having a pulse width corresponding to a number of '1s' or '0s' of video data;

a data driver for converting the video data into a data signal to supply the data signal to the data lines;

a scan driver adapted to supply a scan signal to the scan lines; and an emission control signal supplier for generating an emission control signal for controlling an emitting period of at least one of the pixels in response to the start signal supplied from the controller and for supplying the emission control signal to the emission control lines.

2. The light emitting display according to claim 1, wherein the brightness of the image displaying part is decreased in accordance with the pulse width of the start signal corresponding to the number of '1s' or '0s' of the video data.

3. The light emitting display according to claim 1, wherein the controller comprises:

a counter adapted to count the number of '1s' or '0s' of the video data; and a comparator adapted to compare a count signal from the counter with a reference value and to generate a brightness control signal for selecting the start signal.

4. The light emitting display according to claim 3, wherein the counter counts the number of '1s' or '0s' of a most significant bit of the video data.

5. The light emitting display according to claim 3, wherein the counter counts the number of '1s' or '0s' of a most significant bit and/or a second most significant bit of the video data.

6. The light emitting display according to claim 3, wherein the emission control signal supplier comprises:

a start signal generator adapted to generate start signals having 1st through nth widths that are different from each other, where n is a positive integer greater than 1;

a selector adapted to select one of the start signals having the 1st through nth widths corresponding to the brightness control signal as the start signal; and an emission control signal generator adapted to generate the emission control signal using a clock signal and the start signal.

7. The light emitting display according to claim 6, wherein the selector selects one of the start signals having the 1st width when the count signal is lower than the reference value, and selects one of the start signals having the 2nd through nth widths according to the brightness control signal corresponding to the count signal when the count signal is higher than the reference value.

8. The light emitting display according to claim 6, wherein the selector selects one of the start signals having the 1st width when the count signal is lower than the reference value, and selects a preset one of the start signals having the 2nd through nth widths when the count signal is higher than the reference value.

9. The method according to claim 3, wherein the reference value corresponds to a number of white signals for one frame image supplied to a predetermined area of the image displaying part.

10. The light emitting display according to claim 1, wherein each of the pixels comprises:

a switching part electrically coupled to a power line, a corresponding one of the scan lines and a corresponding one of the data lines, and for outputting a current from the power line in correspondence with the data signal in response to the scan signal supplied to the corresponding one of the scan lines;

a light emitting device for emitting light based on the current transmitted from the switching part; and a switching device connected between the switching part and the light emitting device, and for forming a current path between the switching part and the light emitting device in correspondence with the emission control signal supplied to a corresponding one of the emission control lines.

11. The light emitting display according to claim 10, wherein the switching device cuts off the current supplied to the light emitting device during a period corresponding to the pulse width of the emission control signal of one frame, and supplies the current to the light emitting device to make the light emitting device emit light during another period of the one frame.

12. A method of driving a light emitting display, comprising:

(a) generating a start signal having a pulse width corresponding to a number of '1s' or '0s' of video data;

(b) generating an emission control signal corresponding to the pulse width of the start signal;

(c) converting the video data into a data signal; and (d) supplying a current corresponding to the data signal to a light emitting device in response to a scan signal to make the light emitting device emit light, wherein an emitting period of the light emitting device in (d) is controlled by the emission control signal.

13. The method according to claim 12, wherein brightness of the light emitting device is adjusted by the pulse width of the start signal.

14. The method according to claim 12, wherein (a) comprises:

counting the number of '1s' or '0s' of the video data and generating a count signal; and generating a brightness control signal for selecting the start signal by comparing the count signal with a reference value.

15. The method according to claim 14, wherein said counting the number comprises counting the number of '1s' or '0s' of a most significant bit of the video data.

16. The method according to claim 14, wherein said counting the number comprises counting the number of '1s' or '0s' of a most significant bit and/or a second most significant bit of the video data.

17. The method according to claim 14, wherein (b) comprises:

generating start signals having 1st through nth widths that are different from each other, where n is a positive integer greater than 1;

selecting one of the start signals having the 1st through nth widths corresponding to the brightness control signal as the start signal; and generating the emission control signal using a clock signal and the start signal.

18. The method according to claim 17, wherein (d) comprises:

cutting off the current supplied to the light emitting device during a period corresponding to one of the 1st through nth widths selected for one frame; and supplying the current to the light emitting device to make the light emitting device emit light during another period of the one frame.

19. The method according to claim 17, wherein said selecting one of the start signals having the 1st through nth widths comprises:

selecting one of the start signals having the 1st width when the count signal is lower than the reference value, and selecting one of the start signals having the 2nd through nth widths according to the brightness control signal corresponding to the count signal when the count signal is higher than the reference value.

20. The method according to claim 17, wherein said selecting one of the start signals having the 1st through nth widths comprises:

selecting one of the start signals having the 1st width when the count signal is lower than the reference value; and selecting preset one of the start signals having the 2nd through nth widths when the count signal is higher than the reference value.

* * * * *

UNITED STATES PATENT AND TRADEMARK OFFICE

CERTIFICATE OF CORRECTION

PATENT NO. : 7,576,717 B2
APPLICATION NO. : 11/213320
DATED : August 18, 2009
INVENTOR(S) : Lee et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1024 days.

Signed and Sealed this

Seventh Day of September, 2010

David J. Kappos

David J. Kappos
*Director of the United States Patent and Trademark Office*